US010755680B2

(12) United States Patent
Palmer

(10) Patent No.: US 10,755,680 B2
(45) Date of Patent: Aug. 25, 2020

(54) KEYBOARD SUSTAIN PEDAL STABILIZER

(71) Applicant: Fred Palmer, Detroit, MI (US)

(72) Inventor: Fred Palmer, Detroit, MI (US)

( * ) Notice: Subject to any disclaimer, the term of this patent is extended or adjusted under 35 U.S.C. 154(b) by 0 days.

(21) Appl. No.: 16/270,428

(22) Filed: Feb. 7, 2019

(65) Prior Publication Data

US 2019/0259357 A1 Aug. 22, 2019

Related U.S. Application Data

(60) Provisional application No. 62/631,671, filed on Feb. 17, 2018.

(51) Int. Cl.
*G10C 3/26* (2019.01)
*G05G 1/487* (2008.04)

(52) U.S. Cl.
CPC ..... *G10C 3/26* (2013.01); *G05G 1/487* (2013.01)

(58) Field of Classification Search
CPC ..... G10C 3/26; G05G 1/487
See application file for complete search history.

(56) References Cited

U.S. PATENT DOCUMENTS

2010/0267519 A1* 10/2010 Johnson, II ..... A63B 22/001 482/8
2015/0302835 A1* 10/2015 Dayonot ..... B41J 3/4073 84/430

* cited by examiner

*Primary Examiner* — Kimberly R Lockett
(74) *Attorney, Agent, or Firm* — Gerald R. Black, Esq.

(57) ABSTRACT

The keyboard sustain pedal stabilizer is for use with a keyboard sustain foot pedal. The stabilizer comprises a stabilizer base, a pedal-retention area for retaining the keyboard sustain foot pedal, a pair of sidewalls and an end-wall. The stabilizer base, the pair of sidewalls, the end-wall, and the pedal-retention area are made of one-piece of material. The keyboard sustain pedal stabilizer may be made of one-piece of material, the one-piece of material being a natural rubber, a synthetic rubber, or a blend of one or natural rubbers and one or more synthetic rubbers. The keyboard sustain pedal stabilizer has no moving parts. The top surface of the keyboard sustain pedal stabilizer has non-slipping properties and the underside of the device has non-skid properties. An opening for positioning a foot pedal cord is disposed in either an end-wall, a sidewall, or between the end-wall and a sidewall.

20 Claims, 7 Drawing Sheets

KEYBOARD SUSTAIN PEDAL STABILIZER

CROSS-REFERENCE TO RELATED APPLICATIONS

This Application is related to and claims priority to U.S. Provisional Application No. 62/631,671, entitled "Keyboard Sustain Pedal Stabilizer" (Fred Palmer), filed on Feb. 17, 2018.

FIELD OF USE

The present invention relates to keyboard sustain foot pedals, and particularly to a keyboard sustain pedal stabilizer for use with a keyboard sustain foot pedal.

BACKGROUND OF THE INVENTION

Keyboards have the advantage over acoustic pianos in terms of portability, versatility and ease of amplification but many keyboards lack the capacity for expression that pianos. With the right foot pedal, however, a keyboard can communicate compositions from the likes of Debussy and even achieve effects far beyond the capabilities of the highest-quality concert pianos. Currently, there are available a selection of keyboard sustain, volume and expression pedals sure to contain the perfect accessory to take keyboard performances to the next level.

Shoes, including athletic shoes, work boots, dress shoes, overshoes, and all manner of footwear, provide poor traction on many wet surfaces. The difficulties of moving across a slippery surface, often result in inconvenience and injury. Slips, falls, and resultant injuries are typically caused by a lack of good footing. And even if a musician does not actually fall, the need to maintain one's proper balance on a wet or a slippery surface may cause loss of rhythm for a musician.

A keyboard sustain pedal is known for use with a modern piano or keyboard. When pressed, the keyboard sustain pedal sustains all the damped strings on the piano by moving all the dampers away from the strings and allowing them to vibrate freely. All notes played will continue to sound until the vibration naturally ceases, or until the pedal is released.

Conventionally, musicians use foot pedals for various musical effects. While playing their instruments and depressing their foot pedals, they may find that the foot pedals slip from their original position. The foot pedal tends to shift from its original position when depressed. The musician, while playing, has to reach with his foot to return the foot pedal to its original position.

Some of the Prior Art Includes:

U.S. Pat. No. 7,511,212 (Chang) discloses a musical instrument stand assembly with a foldable pedal. The musical instrument stand assembly with a foldable pedal includes a main stand body, and the main stand body includes a main rod, and the bottom of the main rod includes two support rods each with a recession, and the recession includes a first circular serration; two side frames, and a sidewall of each side frame includes a protrusion and a second circular serration at the protrusion, and each side frame is installed by engaging each protrusion with the recession of each support rod, such that the first and second circular serrations are engaged with each other. With the design of rotably engaging the two side frames and the two support rods, the main stand body of the musical instrument has the function of adjusting its inclination with respect to a vertical position, and the effect of conveniently folding the pedal of the musical instrument.

U.S. Pat. No. 7,655,854 (Wang) discloses a pedal support for percussion instruments. The pedal support comprises a frame including a perpendicularly door-shaped supporting portion and a horizontal mounting portion, the supporting portion being fixed on the mounting member and including two ends, each having a positioning hole formed thereon, the two positioning holes axially coupling with two L-shaped connecting members individually so that the connecting members allow to swing between a first position and a second position, and each of the connecting members including a retaining slot; and a U-shaped piece being pivotally connected to one end of the mounting portion, wherein as the connecting members are located at the first position, the connecting members and the frame are in a retracted status, as the connecting members are located at the second position, the retaining slots of the connecting members engage on the U-shaped piece.

U.S. Pat. No. 9,858,904 (Gold) discloses an insertable percussion system. The system includes a percussion instrument; an inserting/retracting coupled to the percussion instrument for moving the first percussion instrument to a desired position with respect to a second percussion instrument; the inserting/retracting mechanism including a motor, an input device for receiving an operation instruction and generating an operation signal based on the operation instruction, a feedback mechanism for obtaining position information of the first percussion instrument and generating a feedback signal representative of the position information, and a controller electrically coupled to the input device, the motor. The feedback mechanism for actuating the motor based on the operation signal and the feedback signal.

Typically, musicians will try to prevent the foot pedal from moving on the floor by placing a brick or something heavy behind the keyboard sustain foot pedal.

What is needed is a keyboard sustain pedal stabilizer that does not have any moving parts, has no connection to the keyboard stand, is easy to use, requires no set-up time, is transportable, and is compatible with essentially any keyboard sustain foot pedal.

The primary objective of the present invention is to provide a keyboard sustain pedal stabilizer for a keyboard sustain pedal that provides stability for positioning the keyboard sustain foot pedal.

Another objective of the present invention is to provide an attachable pedal cover comprised of a rubber-type pad with an anti-slip means for preventing slipping of the operator's foot during pedal operation in a stable manner, the keyboard sustain pedal stabilizer engaging in a stable manner with the floor.

It is another objective of the present invention to provide a keyboard sustain pedal stabilizer for a keyboard sustain foot pedal that is compatible with floors having varying textures and hardness.

SUMMARY OF THE INVENTION

The keyboard sustain pedal stabilizer of the present invention addresses these needs and objectives.

The keyboard sustain pedal stabilizer of the present invention is for use with a keyboard sustain foot pedal. The keyboard sustain pedal stabilizer comprises a stabilizer base, and a pedal-retention frame area for retaining the keyboard sustain foot pedal. The pedal-retention frame area is abutted by a pair of sidewalls, and an end-wall. The stabilizer base, the pair of sidewalls, the end-walls, and the pedal-retention frame area are preferably made of a single piece of material, a polymer having a non-slip top surface. The keyboard sustain pedal stabilizer of the present invention preferably has a non-slip underside.

The keyboard sustain pedal stabilizer preferably also includes a neck section, the neck section being disposed between the stabilizer base and the pedal retention frame area. The keyboard sustain foot pedal preferably includes a cord for securing to a keyboard. A notch is disposed in either an end-wall, one of the sidewalls, or between the end-wall and one of the sidewalls for positioning the cord. The area abutting the pair of sidewalls is preferably narrower than the stabilizer base.

Preferably, the top surface of the stabilizer base has non-slipping properties, and the underside of the keyboard sustain pedal stabilizer has non-skid properties. The keyboard sustain pedal stabilizer is either made of a material of a natural rubber, a synthetic rubber, or a blend of one or natural rubbers and one or more synthetic rubbers. Alternatively, a layer of either a material of a natural rubber, a synthetic rubber, or a blend of one or natural rubbers and one or more synthetic rubbers is disposed on the undersurface of the keyboard sustain pedal stabilizer.

The keyboard sustain pedal stabilizer has no moving parts. The keyboard sustain pedal stabilizer includes a top surface and an underside. Preferably, the top surface is essentially parallel to the underside.

As used herein, a "keyboard" instrument includes any instrument equipped with a keyboard, a row of levers which are pressed by the fingers. The most common of these are the piano, organ, and various electronic keyboards, including synthesizers and digital pianos. Other keyboard instruments, which are struck idiophones operated by a keyboard, which are usually housed in bell towers or belfries of churches or municipal buildings. In its broadest sense, the term keyboard instrument is applied to any instrument equipped with a keyboard and thus may be used to refer to accordions, percussion instruments and many electronic instruments—such as by way of non-limiting example, a celesta, a harpsichord, a virginal, and a carillon, a Moog synthesizer, a spinet keyboard and an Ondes Martenot.

Preferably, the keyboard sustain pedal stabilizer of the present invention does not connect to the keyboard instrument in any way. The keyboard sustain pedal stabilizer is compatible with substantially any keyboard sustain pedal. The keyboard sustain pedal stabilizer may be made by a 3D printing process. In one preferred embodiment, the keyboard sustain pedal stabilizer is a black rigid polypropylene material, such as an oriented polyethylene terephthalate, or a simulated polypropylene material and preferably having a fairly non-aggressive tread pattern.

For a complete understanding of the keyboard sustain pedal stabilizer of the present invention, reference is made to the accompanying drawings and description in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

DETAILED DESCRIPTION OF THE PREFERRED EMBODIMENTS

Figure 1:
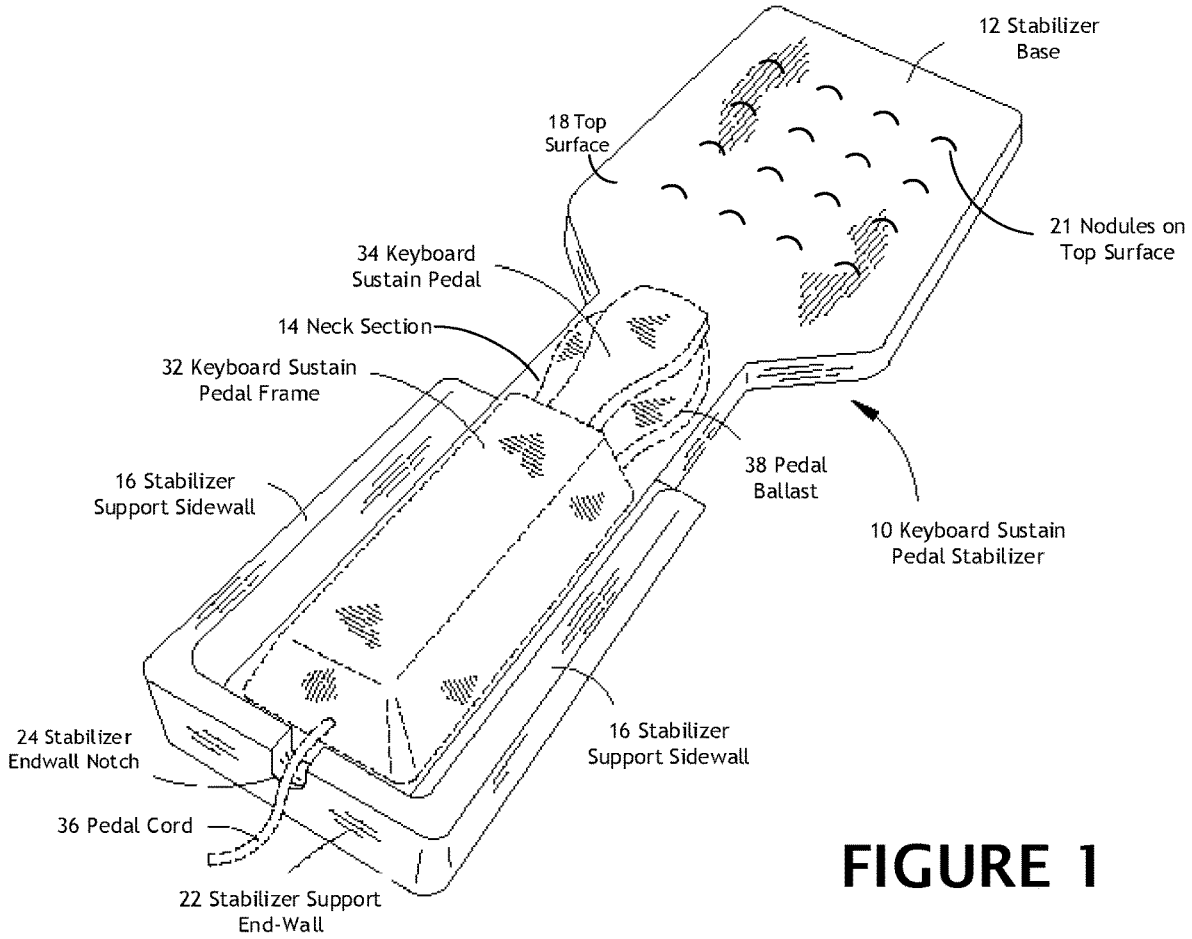
FIG. 1 is an assembly view depicting a keyboard sustain pedal mounted upon a first preferred embodiment the keyboard sustain pedal stabilizer of the present invention.
Figure 2:
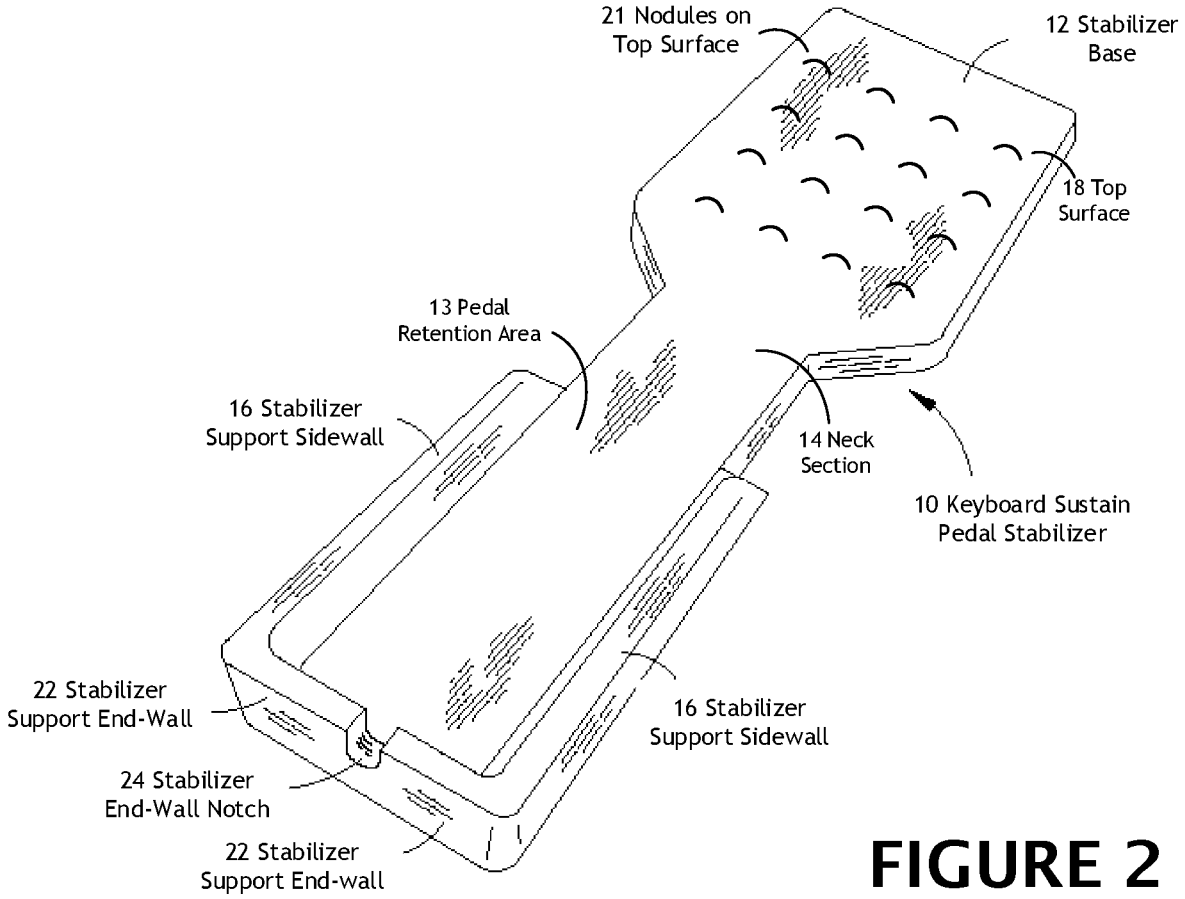
FIG. 2 is an isometric view of the keyboard sustain pedal stabilizer of FIG. 1.
Figure 3:
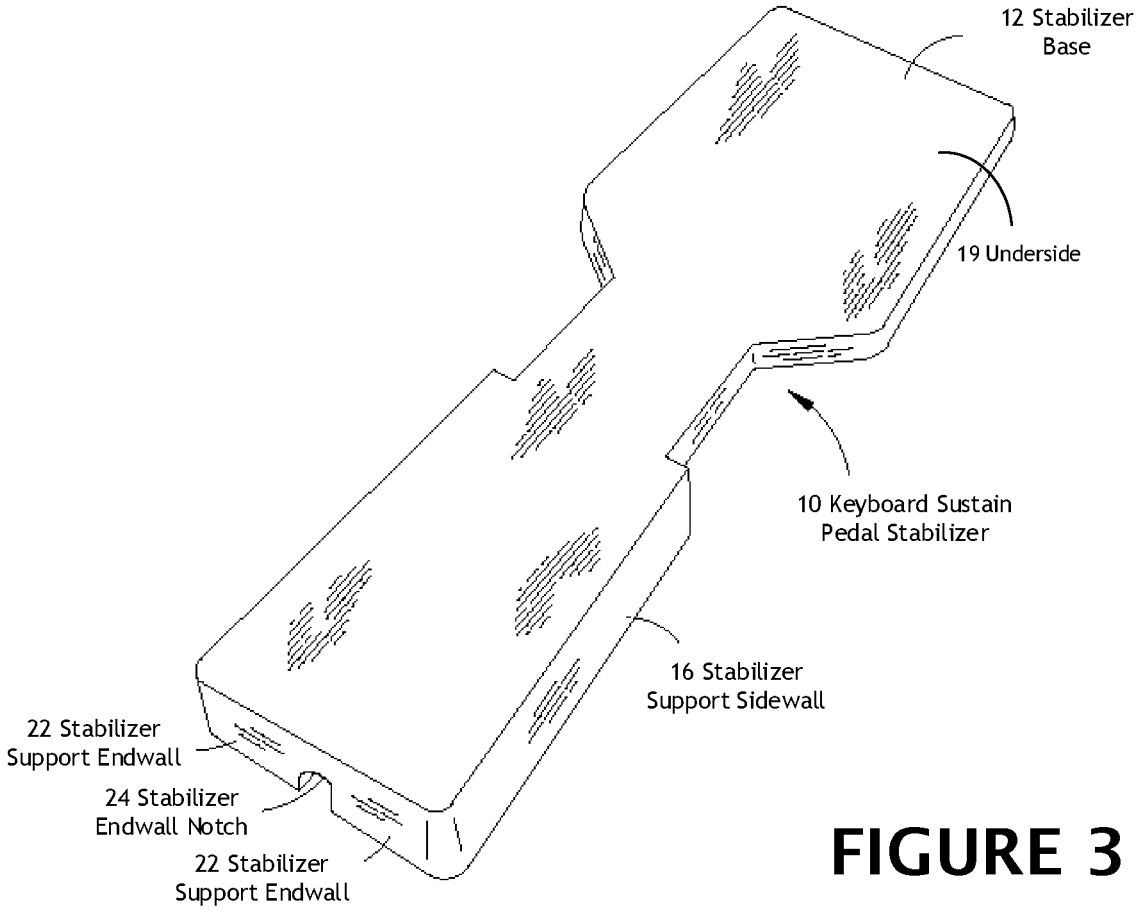
FIG. 3 is a bottom view of the keyboard sustain pedal stabilizer of FIG. 1.
Figure 4:
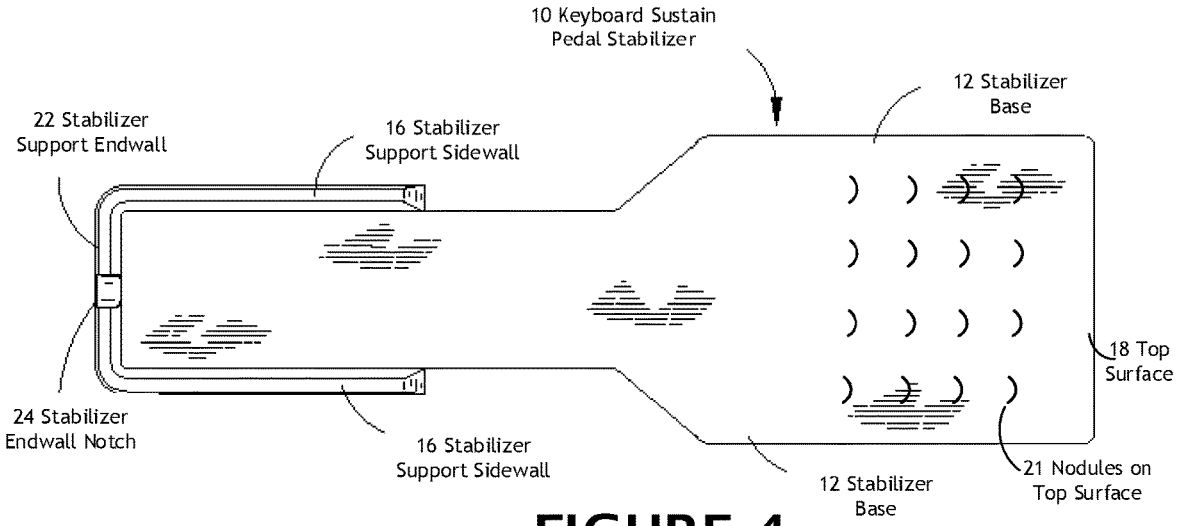
FIG. 4 is a top view of the keyboard sustain pedal stabilizer of FIG. 1.
Figure 5:
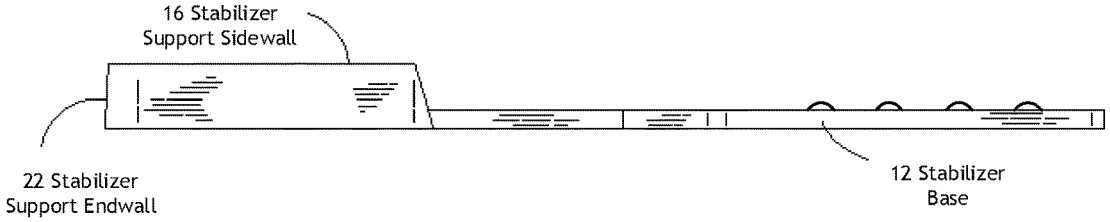
FIG. 5 is a front side view of the keyboard sustain pedal stabilizer of FIG. 1.
Figure 6:
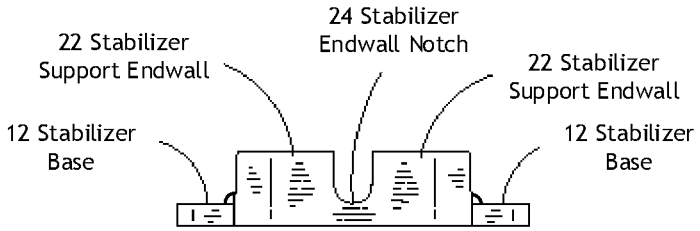
FIG. 6 is a left end view of the keyboard sustain pedal stabilizer of FIG. 1.
Figure 7:
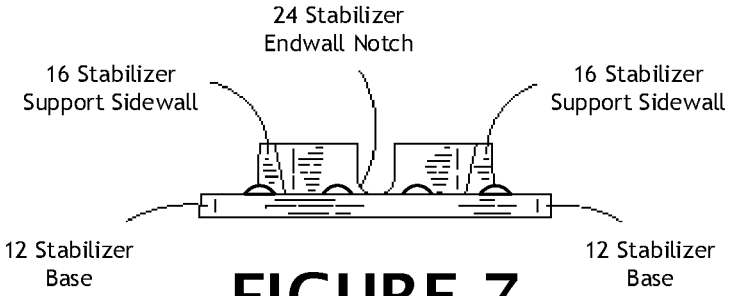
FIG. 7 is a right end view of the keyboard sustain pedal stabilizer of FIG. 1.

Referring now to the drawings, FIG. 1 depicts a keyboard instrument sustain foot pedal [32] (in dotted lines) positioned atop a first preferred embodiment of the keyboard sustain pedal stabilizer of the present invention [10].

The keyboard sustain pedal stabilizer of the present invention is for use with a keyboard sustain foot pedal. The keyboard sustain pedal stabilizer [10] comprises a stabilizer base [12], and a pedal-retention frame area [13] for retaining the keyboard sustain foot pedal [32]. The pedal-retention frame area [13] is abutted by a pair of sidewalls [16], and an end-wall [22]. The stabilizer base [12], the pedal-retention frame area [13] the pair of sidewalls [16], and the end-walls [22] are preferably made of a single piece of material, a polymer having a non-slip top surface, which are preferably a plurality of rows of aligned nodules [21] protruding upwardly. Also, the keyboard sustain pedal stabilizer of the present invention [10] preferably has a non-slip underside [19].

The keyboard sustain pedal stabilizer of the present invention [10] preferably also includes a neck section [14], the neck section [14] being disposed between the stabilizer base [12] and the pedal retention frame area [13]. The keyboard sustain foot pedal [32] preferably includes a cord [36] for securing to a keyboard. A notch [24] is disposed in the end-wall [22] for retaining and positioning the cord [36].

In one preferred embodiment, the keyboard sustain pedal stabilizer [10] is one-piece construction and made of a darkened or black rigid polypropylene material, such as an oriented polyethylene terephthalate, or a simulated polypropylene material and preferably having a fairly non-aggressive tread pattern.

In another preferred embodiment, the under-layer that contacts with a floor is made of a wear-resistant, anti-skid polymer such as a polyurethane, a styrene butadiene copolymer, or a polycarbonate. Other materials suitable for forming the bottom layer include acrylic terminated aromatic polyurethanes and epoxides. The bottom layer could generally be cross-linked highly (e.g., 10-50 mole percent), and its glass transition temperature, when measurable, could be below 5 degrees C. and in any case below 10 degrees C. The bottom layer could be formed so as to have a high surface energy, so that it does not lose all affinity to a floor surface even in the presence of a film of water on the floor surface.

In another preferred embodiment of the present invention, the keyboard sustain pedal stabilizer is made deploying conventional 3D print technology. There are different 3D printing technologies and materials that can be used, but all are based on the principle that a digital model is turned into a solid three-dimensional physical object by adding material layer by layer. In addition, 3D printing does not require tools and molds.

Such processes are well-known in the art as shown on-line at 3D Printing Tutorial: 3D Printing from SketchUp" (https://all3dp.com/best-3d-printing-tutorial/). See also U.S. Pat. No. 10,005,126 (Page), U.S. Pat. No. 9,977,840 (Makeig); U.S. Pat. No. 9,498,902 (Bodet et al.); and U.S. Pat. No. 9,393,724 (Olaru).

U.S. Pat. No. 9,498,902 (Bodet et al.) discloses a press for manufacturing a one-piece object and method for using said press. A press for manufacturing a one-piece object includes two rotary plates which are parallel but offset, each carrying a mold having two portions. Each mold portion can be placed above or below, so that the mold portion of the first mold situated above faces the mold portion of the second mold situated below. First parts of the object, for example skirts, are inserted in the press in an insertion zone. In parallel, second parts, for example caps, are introduced into an introduction zone. In a common zone, third parts, for example dispensing heads, are over-molded on the first and second parts brought close in the common zone in the same position as in the finished object. After opening the press, the plates are turned so that the finished objects are in the portion of the second mold.

U.S. Pat. No. 9,393,724 (Olaru) discloses a multi shot injection molding apparatus. The multi shot injection molding apparatus comprises a stationary machine platen, a first mold plate, a first injection unit connected to a first mold plate for delivering a first molding material to a plurality of first molding cavities, a movable machine frame, a carrier coupled to a movable machine platen, a second mold plate, a second injection unit for delivering a second molding material to a plurality of second molding cavities, a rotary handling unit having a first plurality of rotary handling unit mold cavity portions n and a second plurality of rotary handling unit mold cavity portions, wherein the rotary handling unit is positionable in a first position and is configured to remove the first portions of the molded parts, a first locking mechanism, a second locking mechanism, a processing station and an ejection station.

Figure 8:
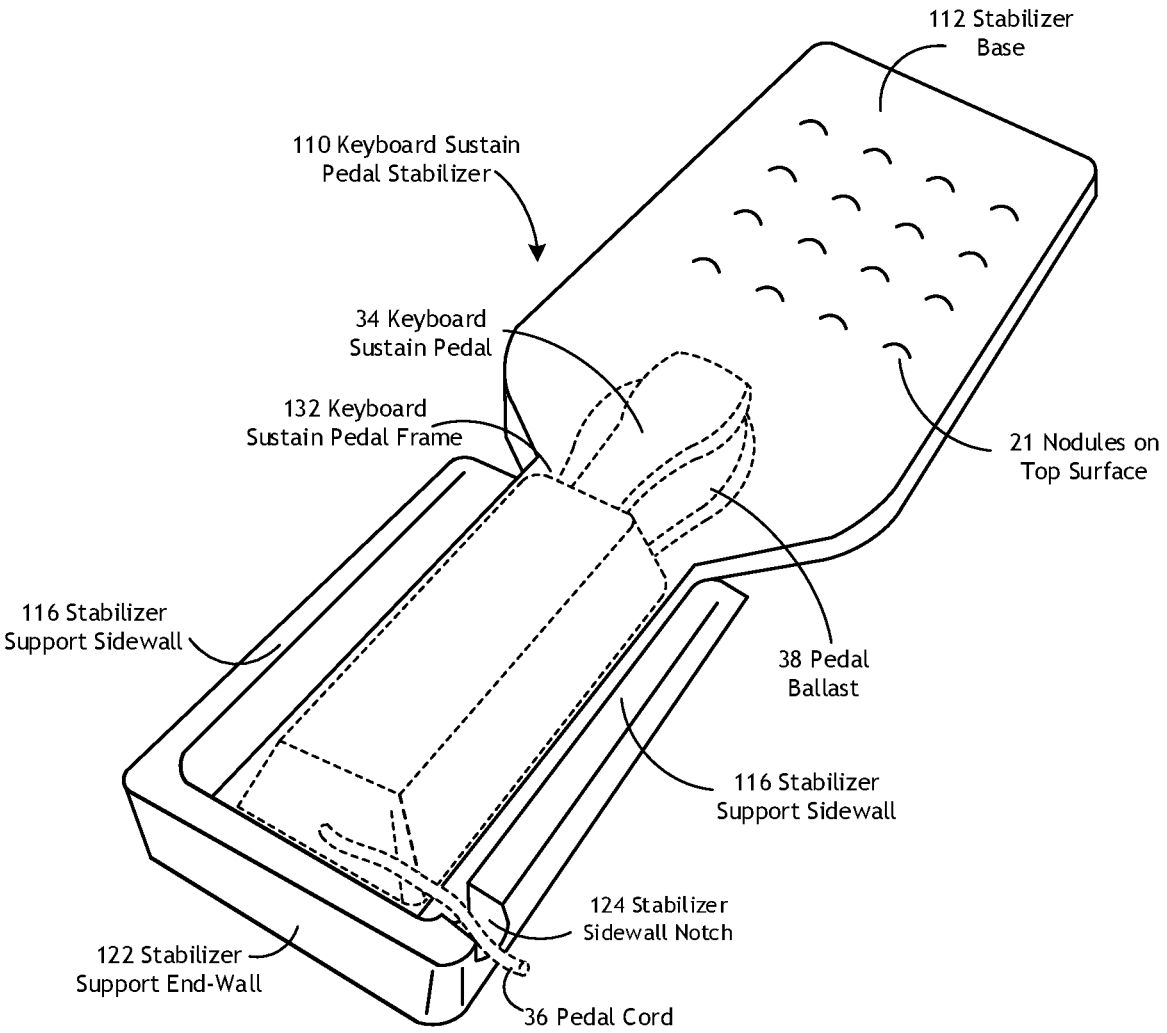
FIG. 8 is an assembly view depicting a keyboard sustain pedal mounted upon a second preferred embodiment the keyboard sustain pedal stabilizer of the present invention.

FIG. 8 is an assembly view depicting a keyboard sustain pedal mounted upon a second preferred embodiment the keyboard sustain pedal stabilizer of the present invention [110].

The keyboard sustain pedal stabilizer of the present invention is for use with a keyboard sustain foot pedal. The keyboard sustain pedal stabilizer [110] comprises a stabilizer base [12], and a pedal-retention frame area [13] for retaining the keyboard sustain foot pedal [32]. The pedal-retention frame area [13] is abutted by a pair of sidewalls [16], and an end-wall [22]. The stabilizer base [12], the pedal-retention frame area [13] the pair of sidewalls [16], and the end-walls [22] are preferably made of a single piece of material, a polymer having a non-slip top surface, which are preferably a plurality of rows of aligned nodules [21] protruding upwardly. Also, the keyboard sustain pedal stabilizer of the present invention [110] preferably has a non-slip underside [19].

The keyboard sustain foot pedal [32] preferably includes a cord [36] for securing to a keyboard. A notch [124] is disposed in a sidewall [116] for retaining and positioning the cord [36].

Figure 9:
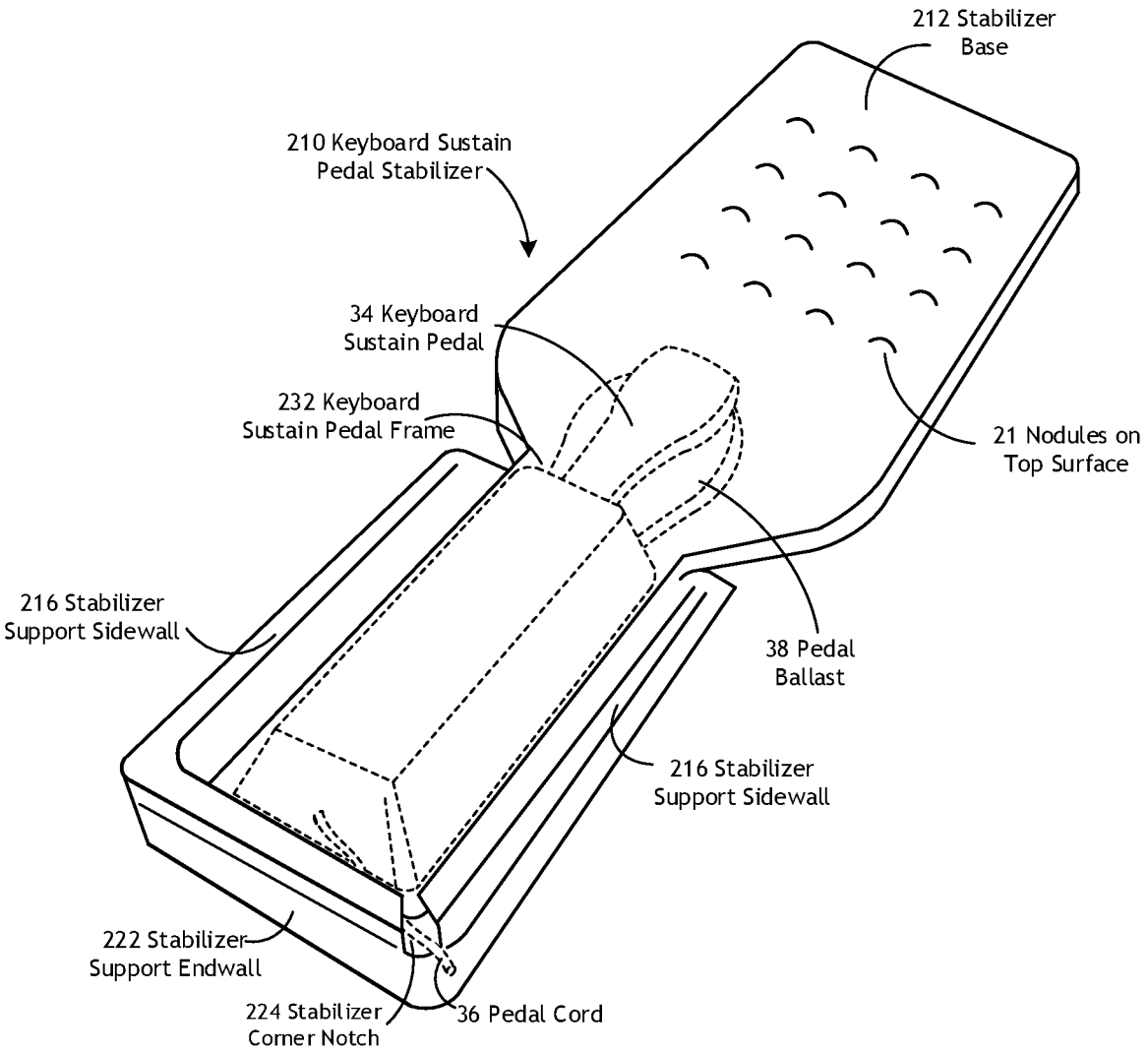
FIG. 9 is an assembly view depicting a keyboard sustain pedal mounted upon a third preferred embodiment the keyboard sustain pedal stabilizer of the present invention.

FIG. 9 is an assembly view depicting a keyboard sustain pedal mounted upon a third preferred embodiment the keyboard sustain pedal stabilizer of the present invention [210].

The keyboard sustain pedal stabilizer of the present invention is for use with a keyboard sustain foot pedal. The keyboard sustain pedal stabilizer [210] comprises a stabilizer base [212], and a pedal-retention frame area [13] for retaining the keyboard sustain foot pedal [32]. The pedal-retention frame area [13] is abutted by a pair of sidewalls [216], and an end-wall [222]. The stabilizer base [212], the pedal-retention frame area [13] the pair of sidewalls [216], and the end-wall [222] are preferably made of a single piece of material, a polymer having a non-slip top surface, which are preferably a plurality of rows of aligned nodules [21] protruding upwardly. Also, the keyboard sustain pedal stabilizer of the present invention [210] preferably has a non-slip underside [19].

The keyboard sustain foot pedal [32] preferably includes a cord [36] for securing to a keyboard. A notch [224] is disposed between a sidewall [216] and the end-wall [222] for retaining and positioning the cord [36].

Throughout this application, various patents and applications are referenced by number and inventor. The disclosures of these documents in their entireties are hereby incorporated by reference into this specification in order to more fully describe the state of the art to which this invention pertains.

It is evident that many alternatives, modifications, and variations of the keyboard sustain pedal stabilizer of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

PARTS LIST

10. Keyboard Sustain Pedal Stabilizer—1st Embodiment
12. Stabilizer Base
13. Pedal Retention Area
14. Neck Section
16. Stabilizer Support Sidewall
18. Top Surface
19. Underside
21. Nodules on Top Surface
22. Stabilizer Support End-Wall
24. Stabilizer End-Wall Notch
32. Keyboard Sustain Pedal Frame
34. Keyboard Sustain Pedal
36. Pedal Cord
38. Pedal Ballast
110. Keyboard Sustain Pedal Stabilizer—$2^{nd}$ Embodiment
112. Stabilizer Base
116. Stabilizer Support Sidewall
122. Stabilizer Support End-Wall
124. Stabilizer Sidewall Notch
132. Keyboard Sustain Pedal Frame
210. Keyboard Sustain Pedal Stabilizer—$3^{rd}$ Embodiment
212. Stabilizer Base

216. Stabilizer Support Sidewall
222. Stabilizer Support End-Wall
224. Stabilizer Sidewall Notch
232. Keyboard Sustain Pedal Frame

I claim:

1. A keyboard sustain pedal stabilizer for use with a keyboard sustain pedal, said keyboard sustain pedal stabilizer having an underside, said keyboard sustain pedal stabilizer comprising:

a stabilizer base; and a pedal-retention area for securely retaining said keyboard sustain foot pedal;

a pair of sidewalls and an end-wall, said pair of sidewalls and said end-wall abutting said pedal-retention area; and whereby said stabilizer base, said pair of sidewalls, said end-wall, and said pedal-retention area are made of a single piece of material.

2. The keyboard sustain pedal stabilizer of claim 1, further comprising a neck section disposed between a ballast section and said area for retaining said keyboard sustain foot pedal.

3. The keyboard sustain pedal stabilizer of claim 1, wherein said keyboard sustain pedal stabilizer is made of a natural rubber material, a synthetic rubber material, or a blend of one or more natural rubber materials and one or more synthetic rubber materials.

4. The keyboard sustain pedal stabilizer of claim 1, wherein said keyboard sustain pedal includes a pedal cord, further comprising an opening being disposed in either said end-wall, one of said sidewalls, or between said end-wall and one of said sidewalls for positioning said pedal cord.

5. The keyboard sustain pedal stabilizer of claim 1, wherein said keyboard sustain pedal stabilizer is made of a polymer, said polymer having a non-slip top surface and a non-slip underside.

6. The keyboard sustain pedal stabilizer of claim 1, wherein said top surface has non-slipping properties, and said underside has non-skid properties.

7. The keyboard sustain pedal stabilizer of claim 1, wherein said keyboard sustain pedal stabilizer is made by a 3D-printing process.

8. A keyboard sustain pedal stabilizer for use with a keyboard sustain foot pedal, said keyboard sustain pedal stabilizer having an underside, said keyboard sustain pedal including a pedal cord, said keyboard sustain pedal stabilizer comprising:

a stabilizer base having a top surface; and a pedal-retention area for securely retaining said keyboard sustain foot pedal;

a pair of sidewalls and an end-wall, said pair of sidewalls and said end-wall abutting said pedal-retention area; and whereby an opening is disposed in either said end-wall, one of said sidewalls, or between said end-wall and one of said sidewalls for positioning said pedal cord.

9. The keyboard sustain pedal stabilizer of claim 8, further comprising a neck section disposed between a ballast section and said area for retaining said keyboard sustain foot pedal.

10. The keyboard sustain pedal stabilizer of claim 8, wherein said keyboard sustain pedal stabilizer is made of a natural rubber material, a synthetic rubber material, or a blend of one or more natural rubber materials and one or more synthetic rubber materials.

11. The keyboard sustain pedal stabilizer of claim 8, wherein said stabilizer base, said pair of sidewalls, said end-wall, and said pedal-retention area are made of a single piece of material.

12. The keyboard sustain pedal stabilizer of claim 8, wherein said keyboard sustain pedal stabilizer is made of a polymer, said polymer having a non-slip top surface and a non-slip underside.

13. The keyboard sustain pedal stabilizer of claim 8, wherein said top surface has non-slipping properties, and said underside has non-skid properties.

14. A keyboard sustain pedal stabilizer for use with a keyboard sustain foot pedal, said keyboard sustain pedal stabilizer having an underside, said keyboard sustain pedal stabilizer comprising:

a stabilizer base having a top surface; and a pedal-retention area for securely retaining said keyboard sustain foot pedal;

a pair of sidewalls and an end-wall, said pair of sidewalls and said end-wall abutting said pedal-retention area; and whereby said top surface has non-slipping properties, and said underside has non-skid properties.

15. The keyboard sustain pedal stabilizer of claim 14, further comprising a neck section disposed between a ballast section and said area for retaining said keyboard sustain foot pedal.

16. The keyboard sustain pedal stabilizer of claim 14, wherein said keyboard sustain pedal stabilizer is made of a natural rubber material, a synthetic rubber material, or a blend of one or more natural rubber materials and one or more synthetic rubber materials.

17. The keyboard sustain pedal stabilizer of claim 14, wherein said keyboard sustain pedal includes a pedal cord, further comprising an opening being disposed in either said end-wall, one of said sidewalls, or between said end-wall and one of said sidewalls for positioning said pedal cord.

18. The keyboard sustain pedal stabilizer of claim 14, wherein said keyboard sustain pedal stabilizer is made of a polymer, said polymer having a non-slip top surface and a non-slip underside.

19. The keyboard sustain pedal stabilizer of claim 14, wherein said stabilizer base, said pair of sidewalls, said end-wall, and said pedal-retention area are made of a single piece of material.

20. The keyboard sustain pedal stabilizer of claim 14, wherein said keyboard sustain pedal stabilizer is made by a 3D-printing process.

* * * * *